United States Patent [19]

Jolin

[11] 3,992,607

[45] Nov. 16, 1976

[54] ELECTRICALLY HEATED HOT WATER SYSTEM

[76] Inventor: Jacques R. Jolin, 1017 rue Rolland-Therrien, Longueuil, Quebec J4J 3L4, Canada

[22] Filed: Apr. 25, 1975

[21] Appl. No.: 571,571

[52] U.S. Cl. ..... 219/314; 137/266; 165/108; 219/316; 219/320; 219/330

[51] Int. Cl.[2] ..... F24H 1/18

[58] Field of Search ..... 219/314, 312, 316, 320, 219/330, 341, 335, 365, 382, 275; 237/16–18; 165/106, 108; 137/266; 122/214

[56] References Cited

UNITED STATES PATENTS

| | | | |
|---|---|---|---|
| 2,307,061 | 1/1943 | Morrow | 219/330 |
| 2,427,146 | 9/1947 | Lee | 219/312 X |
| 2,700,505 | 1/1955 | Jackson | 219/341 |
| 2,834,865 | 5/1958 | Coates | 219/314 |
| 3,280,299 | 10/1966 | Doniak | 219/306 X |
| 3,484,580 | 12/1969 | Morgan | 219/314 |
| 3,868,494 | 2/1975 | Pepin | 219/314 X |

*Primary Examiner*—C. L. Albritton

[57] ABSTRACT

An electrically heated hot water system made of two superposed interconnected closed containers having a substantially elongated shape, a water inlet provided at the bottom of the lower container and a water outlet provided at the top of the upper container, two tubular members connecting the top surface of the lower container to the bottom surface of the upper container for allowing the water of the bottom container to raise into the upper container, immersible electrical heating elements disposed substantially across each container for heating the water adapted to be contained in the said containers, and a thermostatic control device connected to each container and to each heating element for maintaining the temperature of the water contained in each container at a predetermined degree, whereby the water heated in the containers by the heating elements is raised from the lower container to the tubular members.

5 Claims, 2 Drawing Figures

ELECTRICALLY HEATED HOT WATER SYSTEM

Figure 1:
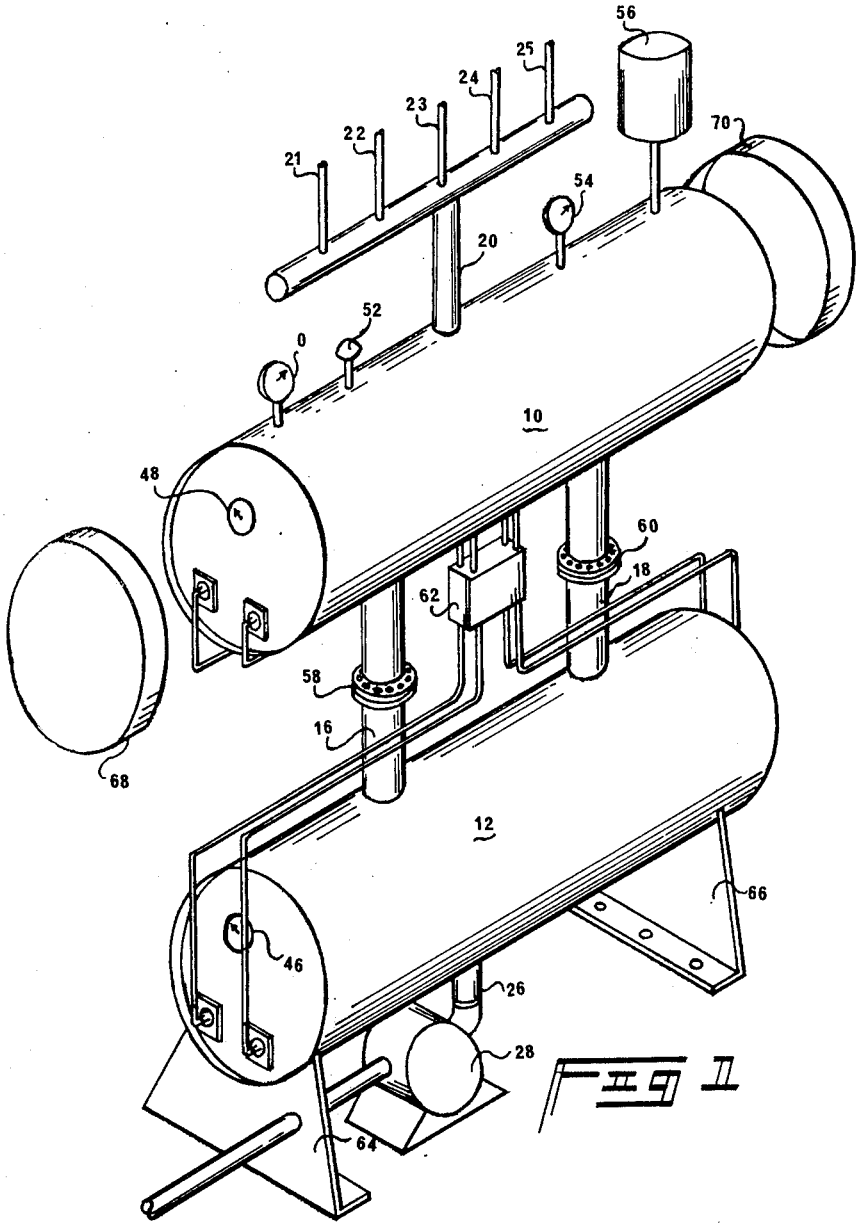

The present invention is directed to an electrically heated hot water system and in particular to a system in which the hot water is supplied by two superposed interconnected closed containers.

The invention may be used for hot water tanks in supplying hot water for household purpose or may be used as a furnace for supplying hot water to a network of radiators. The known hot water tanks consist of a single reservoir in which the cold water flows freely into the mass of hot water. Accordingly, cold water streams can be directed through the hot water outlet without having been sufficiently heated.

An electrically heated central hot water system is disclosed in U.S. Pat. No: 3,620,450 in which two separate interconnected vessels provide a series of heated storage water columns. The lower part of the reservoir which is not heated is connected to the upper part of the heated reservoir for the purpose of mixing warm water from the first reservoir to the hot water of the second one. The upper part of the heated reservoir is connected to the upper part of the non-heated reservoir.

According to the present invention, which is directed to an electrically heated hot water system, it comprises two superposed interconnected closed containers, a water inlet provided near the bottom of the lower container and a water outlet provided near the top of the upper container, a piping device connecting the top surface of the lower container to the bottom surface of the upper container for allowing the water of the bottom container to raise into the upper container, electrical heating means disposed in each container for heating the water adapted to be contained in the said containers, and thermostatic control means for each container connected to the heating means contained therein, for maintaining the temperature of the water contained in each container at a predetermined degree, whereby the water heated in the containers by the heating means is raised from the lower container to the upper container through the said piping device.

This system may be used for supplying hot water for household purpose but may also be used for supplying hot water to a network of radiators. The water outlet provided at the top of the upper container is then connected to the network of the radiators.

According to the present invention, the system is efficient, simple and easy to maintain. It is also silent, odorless and non-polluting. As compared to the usual electrically heated system which specifies wiring in each room throughout the building, the present one requires less wiring and is consequently safer.

According to the present invention, no large amount of water is required because the same water is re-circulated continuously. With this system, there is no use to add any amount of chemical products to counteract the foreign matters contained in the water.

Compared to a fuel system which needs a large fuel reservoir in addition to the furnace, the present system requires a relatively small space.

Another object of the invention is that it is economical because the system foresees a reserve of hot water which is not disturbed by the cool water coming back from the radiators and which is ready to supply a uniformly heated volume of water.

Figure 2:
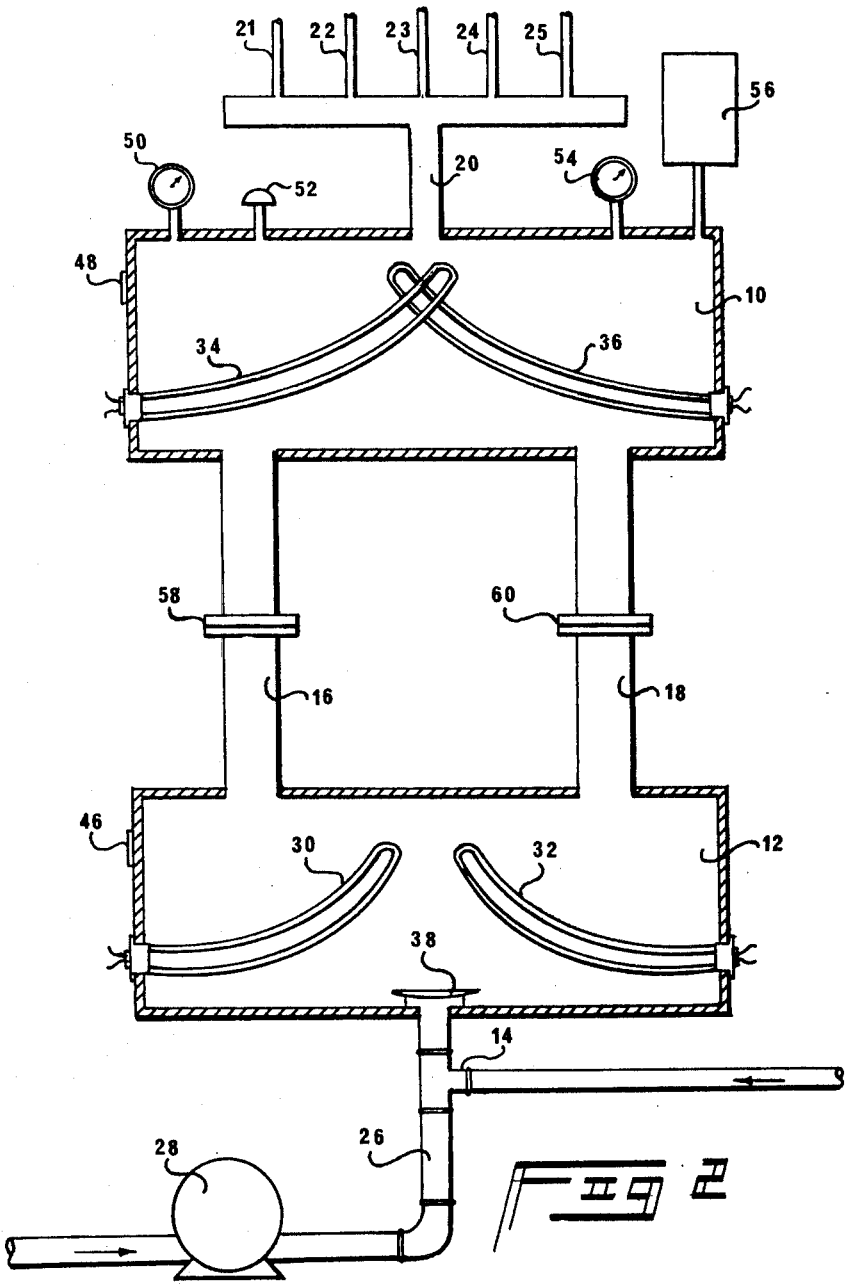

The invention will now be described in greater details by referring to drawings, wherein FIG. 1 is a perspective view of an embodiment of a heating system according to the present invention, and FIG. 2 is a hardly cross-sectional view through the embodiment shown in FIG. 1.

The system comprises an upper container 10 and a lower container 12 which are both full of water or supplied with water from a main source such as the city through said inlet tube 14. The water passes from the container 12 to the container 10 by the tubular members 16 and 18 which are connected between the upper surface of the lower container 12 to the bottom surface of the upper container 10. At the top surface of the upper container 10 is connected a water outlet 20 which supplies a plurality of networks of radiators through the outlet pipes 21, 22, 23, 24 and 25. The water which has circulated through the radiators is returned to the lower container 12 through the pipe 26, through the circulating pump 28.

The water in container 12 is heated by immersible electrical heating elements 30 and 32 which are secured to the opposite ends of the container and extend towards each other at an angular direction inside the container. They are located so as to cross the straight path between the inlet tube 26 and the piping device 16 and 18. Similarly, immersible electrical heating elements 34 and 36 are secured to the opposite ends of the container 10 and extend toward each other at an angle and cross each other to guarantee that no water can move directly from the inlet of the piping devices 16 and 18 to the outlet of the tube 20 without passing close to one of the two heating elements 34 and 36. The heating elements in both containers may but do not necessarily have to overlap each other.

Another way of preventing the direct flow of water from the inlet of a reservoir to the outlet, is by providing a deflector over the inlet aperture. For instance, the deflector 38 is mounted over the inlet tube 26. The movement of the incoming water will be changed from a substantially vertical to a substantially lateral direction. The electrical actuation of the heating elements 30 and 32 is controlled by the thermostat 46 in contact with the surface of the container 12 and similarly the electrical actuation of the heating elements 34 and 36 is controlled by the thermostat 48 in contact with the upper container 10.

For the purpose of normal operation, the upper container is provided with a pressure gage 50, a safety valve 52, a thermometer 54 and an expansion tank 56.

The two containers 10 and 12 are separated so that the cool water coming from the pipe 26 or the water supply 14 will not be mixed immediately to the reserve of hot water contained in the container 12. For this purpose, the two containers 10 and 12 are separated by the piping devices 16 and 18 but the latter must be big enough so as to supply substantially freely the water from the lower to the upper container. In order to realize both of these characteristics, it has been found that the diameter of each of the piping devices 16 and 18 must be about 20% to 30% and preferably 25% of the diameter of the containers 10 and 12. This corresponds to a total cross-sectional area for all the piping devices between the containers 12 and 10 from 16% to 36% of the area of one of the containers.

The piping devices 16 and 18 are used to support the upper container 10 on the lower container 12 and are preferably subdivided in two parts by joint members 58 and 60 for the purpose of maintenance and servicing of the system.

The heating elements 30, 32, 34 and 36 are electrically connected to a junction box 62 which is supplied by the proper amperage.

The lower container 12 is supported by a pair of brackets 64 and 66 and both ends of each container are preferably protected by covers 68 and 70. Additional energy conservation is contemplated by insulating both containers with mineral wool or the like. The two containers 10 and 12 may be of different sizes to meet various needs but for the general purpose, they are preferably of the same size. Container 10 must be of a dimension sufficient to meet urgent needs of hot water while the container 12 must be sufficiently big to supply the container 10 with appropriate demand.

In normal operation, the pressure is set at 15 pounds per square inch and the temperature is set at 130° F. for an average winter day.

However, the pressure may be expected to have a maximum of 30 pounds and the temperature can be raised up to 180° F. The temperature maintained in container 12 can be maintained at a temperature equal or slightly lower (20° F.) than container 10. Accordingly, depending on the required amount of heat (B.T.U.), the temperature of the upper container 10 may be set between 110° F. to 180° F. and the bottom one between 90° F. to 160° F.

As for other electrical requirements for a furnace, the present system must be electrically independent to the electrical household requirement and must be protected by an independent fuse or breaker. It is interesting to note that the present system provides an independent heating supply of water for each network of radiators as exemplified by the outlet 21, 22, 23, 24 25 while only one circulating pump 28 is needed. The volume of water required in both containers can be calculated according to various characteristics of the house, such as its size and according to the type of winter and the degree of comfort which is required. For instance, in a small apartment house of 40 by 45 feet, comprising 5 apartments, each container 10 and 12 having 32 inches in length and 14 inches in diameter were computed as being sufficient to provide the required amount of B.T.U. for a northern climate such as Montreal in Canada. Each container is provided with four electrical elements having 6,000 watts, the electrical elements of each container being connected in parallel.

It has been found that with the arrangement as described above, that is, with two distinct heating zones, the upper zone having the high temperature is immediately available to heat the radiators, while the water returning to the lower container is gradually raised to the desired temperature. This prevents the fact that cool water may be supplied to the circuit or network of radiators which would therefore not provide the required heat to the building and therefore would keep the thermostat of the building in longer demand for heat. Furthermore, when a reserve of hot water is available, the radiators may be provided with an immediate supply and therefore provides heat more quickly.

Although the invention has been described above in relation with a heating system for a network of radiators, it should be understood that the combination of two superposed interconnected closed containers can be used for the purpose of heating water for household purpose such as the sinks, the washing machines, the bath-tubs, etc... Accordingly, with this arrangement, the heating system will not require a circulating pump because the system will receive its pressure from the municipality which may be in the range of 60 pounds. Furthermore, the latter system will not require any elaborate distribution to a network of radiators. An installation such as described above for the small apartment house requires less than a quart of fresh water per winter. Accordingly the same water is constantly recirculated and practically no corrosion or sedimentation problems need to be corrected.

The length of the piping devices 16 and 18 can be maintained relatively short as long as they prevent the direct passage of water from container 12 to 10. A length of 10 to 15 inches is sufficient.

There are advantages in using a thermostat for each heating element instead of only one per pair of elements. If one thermostat fails, only one element stops and the system is not strongly handicapped. Furthermore, the cost of a thermostat adapted for high amperage is considerably higher than the one for low amperage.

What I claim is:

1. An electrically heated hot water system comprising, two superposed interconnected closed containers having a substantially uniform and equal cross-section, a water inlet provided near the bottom of the lower container and a water outlet provided near the top of the upper container, at least two separate vertical tubular members having a substantially uniform horizontal cross-section and extending between the lower and upper containers for allowing the water of the lower container to raise into the upper container, the sum of the cross-sections of both tubular members being within a range of 16% to 36% of the said cross-section of one of said containers, electrical heating means disposed in each container for heating the water adapted to be contained in the said containers, and thermostatic control means for each container connected to the heating means contained therein, whereby, the water heated in said containers by said heating means is raised from the lower container to the upper container through said tubular members.

2. An electrically heated hot water system for supplying hot water to a network of radiators, the said system comprising, two superposed interconnected closed containers having a substantially uniform and equal cross-section, a water inlet provided at the bottom of the lower container and a water outlet provided at the top of the upper container, the latter being adapted to be connected to a network of radiators, at least two separate vertical tubular members having a substantially uniform horizontal cross-section and extending between the lower and upper containers for allowing the water of the lower container to raise into the upper container, the said containers being essentially made of horizontally elongated containers the sum of the cross-sections of both tubular members being within a range of 16% to 36% of the said cross-section of one of said containers, electrical heating means disposed substantially across each container for heating the water adapted to be contained in the said containers, a thermostatic control means for each container connected to the heating means contained therein for maintaining the temperature of the water contained in each container at a predetermined degree, pumping means mounted between the said water outlet and inlet so as to cause the water to circulate from the said bottom to the upper container, whereby, the water heated in said containers by said heating means is raised from the lower container to the upper container through said tubular members and directed to the network of radiators and then returned to the lower container by the pumping means.

3. A system as recited in claim 2, comprising a deflector fixed in the lower container above the water inlet, whereby the movement of the water is deflected substantially from a vertical direction to a lateral direction.

4. A system as recited in claim 2, wherein the said water outlet at the top of the upper container comprises a plurality of tubular elements disposed in parallel relationship, each of said tubular elements being adapted to supply a separate network of radiators.

5. A system as recited in claim 2, wherein the heating elements are mounted at each of opposite ends of each container and along the lower part thereof, and extend toward the center thereof, the said elements being aligned so as to cross the direct path of the water between the inlet and outlet of each container.

* * * * *